US006394813B1

(12) United States Patent
Stout et al.

(10) Patent No.: US 6,394,813 B1
(45) Date of Patent: May 28, 2002

(54) ROTATING CONNECTOR ADAPTOR

(75) Inventors: Gary H. Stout, Farmington; Ryan A. Kunz, Roy, both of UT (US); Joel J. Yeh, Diamond Bar; Ryan Yeh, Chino Hills, both of CA (US); Hui-Tze Tsai, Chung-Hwa (TW)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/657,495

(22) Filed: Sep. 8, 2000

(51) Int. Cl.[7] ..... H01R 25/00; H01R 27/02; H01R 31/00; H01R 39/00

(52) U.S. Cl. ..... 439/11; 439/638

(58) Field of Search ..... 439/11, 13, 14, 439/638

(56) References Cited

U.S. PATENT DOCUMENTS 3,912,352 A * 10/1975 Kinnear ..... 339/8
4,405,877 A * 9/1983 Haraden et al. ..... 313/318
4,542,858 A * 9/1985 Manges ..... 242/54
5,352,122 A * 10/1994 Speyer et al. ..... 439/13
5,588,843 A * 12/1996 Sobhani ..... 439/22
5,628,634 A * 5/1997 Omata ..... 439/13
6,089,874 A * 7/2000 Kroulik et al. ..... 439/11
6,109,926 A * 8/2000 Blum et al. ..... 439/3
6,186,796 B1 * 2/2001 Wedge ..... 439/11

* cited by examiner

*Primary Examiner*—P. Austin Bradley
*Assistant Examiner*—Edwin A. León
(74) *Attorney, Agent, or Firm*—Workman, Nydegger & Seeley

(57) ABSTRACT

A connector adapter that can be used to directly connect a peripheral device to a host device. The connector adapter is adjustable so as to allow selective reorientation of the peripheral with respect to the host device. The connector adapter includes a limiting mechanism that restricts the degree to which the adapter can be selectively rotated. In addition, the adapter includes an indexing mechanism that allows the position of the adapter to be locked in predetermined positions.

9 Claims, 8 Drawing Sheets

ROTATING CONNECTOR ADAPTOR

BACKGROUND OF THE INVENTION

1. Field of the Invention

The present invention relates generally to connectors for interfacing peripherals to a host device. More specifically, the present invention relates to an adaptor configuration that permits a peripheral device to be electrically connected to a host device interface, and yet allows the peripheral to be oriented in any one of a number of physical positions relative to the host interface.

2. Description of Related Art

While today's computers incorporate an increasing amount of functionality within the physical constraints of the computer itself, there are a number of functions that can only be provided by way of an add-on, external peripheral. For instance, joysticks, scanners, digital cameras, wireless network antennas, are all examples of devices that may have to be operatively (i.e., electrically and physically) connected to a host device, such as a computer.

In the past, connecting such peripheral devices to a host involved a fairly complicated process. A user was required to identify the correct interface port and cable, and then properly configure the host and the peripheral device to insure compatible communications between the two devices. The process was often difficult, required a fairly high level of computer expertise, and was often subject to error. In addition to such installation complexities, traditional connection schemes also suffered from other problems as well, such as limited performance capabilities.

Consequently, the computer industry has developed interface schemes that seek to address these and other problems. One such interface scheme is known as the Universal Serial Bus (USB) specification, which defines a connection environment that allows for the connection of computers and peripherals of the sort described above. USB provides several advantages. From a performance standpoint, it allows for a much higher level of data transfer between the peripheral device and the host device.

Further, USB reduces the complexity of connecting a peripheral to a host. Generally, a USB-compliant peripheral can be connected directly to a USB-compliant host, and there is no need for the user to manually configure either of the two devices—the USB environment essentially automates the underlying configuration process in a manner that is transparent to the user.

The USB specification defines the physical design, dimensions, and electrical interface of peripheral devices using a "keyed" connector protocol. In general, the USB standard defines a single USB plug type, that is electrically and physically received by a similarly defined USB port or receptacle. Thus, a peripheral device vendor may provide the user with a cable having a USB plug, that can be physically and electrically received within a USB port on the host device.

USB connectors utilize a fixed orientation with respect to the receptacles for receiving the plugs on the host and peripheral device. Unfortunately, the fixed orientation of the receptacle on the host device is not standardized from one manufacturer to another. As such, a USB plug must be physically oriented in a manner dictated by the host USB receptacle. For example, USB series "A" receptacles can be found on current notebook computers in all of four possible 90-degree orientations. This can be problematic in situations where a USB peripheral must have a specific physical orientation vis-à-vis the host USB receptacle. Solutions include the use of a cable, or a peripheral that is jointed in a manner so as to allow re-orientation of the peripheral. However, such approaches have not been entirely satisfactory. Use of a cable requires another attachment component that is subject to failure and increases attachment complexity. Moreover, a cable does not allow for direct connection of the peripheral to the host. Also, providing a peripheral with multiple joints increases cost and manufacturing complexity of the peripheral.

The need for providing a known, fixed orientation of a peripheral device with respect to a host is especially critical for certain types of peripherals. For example, an antenna for providing wireless data communication requires a certain orientation so as to provide optimal transmission and reception of wireless signals. While the use of USB-based connection schemes are ideal for such antennas from a performance and ease-of-use standpoint, a USB connector may not provide the optimal physical orientation.

Thus, it would be an advance over the present state of the art to provide a connection scheme that provides the advantages of the USB standard, but that allows the peripheral to be physically reoriented with respect to the host device.

SUMMARY OF PRESENTLY PREFERRED EMBODIMENTS

The present invention has been developed in response to the current state of the art, and in particular, in response to these and other problems and needs that have not been fully or completely solved by currently available connector schemes for interfacing peripheral devices with host devices. Thus, it is an overall object of the present invention to provide a reliable, reorienting connection between the attached peripheral device and the host device. Further, it is an objective to provide the connection without the use of a flexible cable; instead, it is an objective to provide a rigid connection between the host and the peripheral. A related object is to provide a reorientation scheme that allows the peripheral to placed in a desired physical orientation with respect to the host, irrespective of the orientation of the interface on the host. For example, if the host interface is a vertical USB receptacle, or a horizontal USB receptacle, it is an objective to allow the peripheral to remain in the same desired position.

To summarize, these and other problems and limitations in the prior art have been addressed by the present invention, which is directed to a connector adapter scheme that allows a peripheral device to be directly connected to a host device having a connector interface. Moreover, the connector adapter is adjustable, so that the relative position of the connected peripheral can be adjusted. This allows, for example, the peripheral to be maintained in a desired position, irrespective of the physical orientation of the host connector interface.

In a presently preferred embodiment, the connector adapter includes a host connector interface, that is capable of electrically and physically interfacing with an interface connector provided on a host device. For example, the host connector may be a USB-type plug, that can interface with a USB-type receptacle provided by the host device. The adapter also includes a peripheral interface, that is capable of providing a detachable electrical connection with a peripheral device, such as a wireless antenna. This can be a proprietary connector scheme, or could be provided with a standardized connector.

Disposed within a housing of the connector adapter is an electrical interconnection that provides the appropriate signal connection between the host connector and the peripheral interface. In a presently preferred embodiment, this interconnection is provided by way of a series of flexible cables. The number and types of signal interconnections provided will typically depend on the type of connectors involved, as well as the type of peripheral being used.

The connector adapter is further constructed to allow the host connector interface portion of the adapter to assume any one of a number of physical orientations. In a preferred embodiment, this is accomplished by interconnecting the peripheral interface section with the connector adapter in a manner such that it is selectively moveable, and preferably rotatable with respect to the rest of the adapter. In this way, the relative position of the peripheral device can be maintained in a desired position, irrespective of the physical orientation of the interface presented by the host device.

In a presently preferred embodiment, the connector adapter also includes means for limiting the degree to which the peripheral interface can be rotated. This prevents excessive twisting and breakage of the internal cable connectors. By way of example, the preferred embodiment restricts rotation of the connector adapter to a range of 270°, although other ranges could also be provided.

Preferred embodiments of the present invention also allow the connector adapter to be rotated in to specific "locked" positions. For example, in one embodiment, the locked positions are oriented at 90° orientations, which corresponds to typical physical orientations of the interface provided on a host device. Further, when selectively rotated to a predetermined position, the mechanism provides a tactile indication to the user.

Additional objects, advantages and features of the invention will be set forth in the description which follows, and in part will be obvious from the description, or may be learned by the practice of the invention.

BRIEF DESCRIPTION OF THE DRAWINGS

In order that the manner in which the above recited and other advantages and objects of the invention are obtained, a more particular description of the invention briefly described above will be rendered by reference to specific embodiments thereof, which are illustrated in the appended drawings. Understanding that these drawing depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

In general, embodiments of the present invention are directed to a connection system and adapter that allow a peripheral to be connected directly to a host interface. Moreover, regardless of the physical orientation of the host interface, the connector adapter provides a degree of adjustability that permits the peripheral to be oriented in a desired physical position relative to the interface and the host device. Thus, the peripheral can be oriented in a desired position, regardless of the physical orientation of the host interface.

Figure 1:
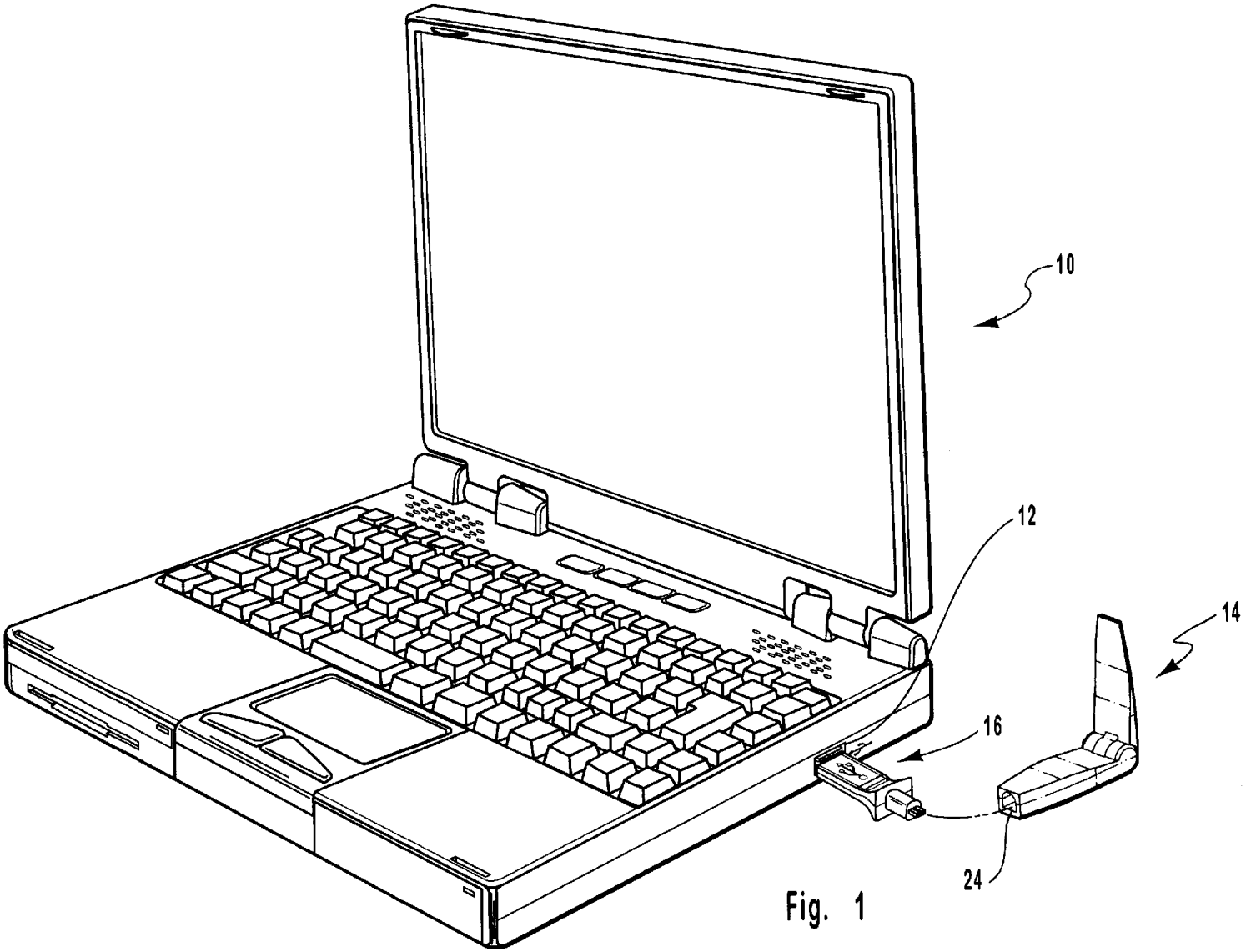
FIG. 1 illustrates an exemplary host system having a USB-type receptacle for interfacing with a USB-type plug provided on an exemplary peripheral having a rotatable connector adapter constructed in accordance with principles of the present invention.

FIG. 1 is illustrative of the sort of environment that embodiments of the present invention find particular applicability. That figure shows a host device, such as a portable computing device 10, that is equipped with an interface port, such as USB receptacle 12. As is well known, the USB receptacle 12, when implemented in accordance with USB standards, provides a standardized electrical and physical interface that allows external peripherals to be operatively interfaced with the host computer device 10. The USB receptacle 12 illustrated in FIG. 1 also has a particular physical orientation, which in turn dictates the orientation of the USB plug when it is operatively received therein. As noted above, the orientation of the USB receptacle can vary from host device to host device. As such, the orientation of the plug must be rotated in a manner that corresponds to the receptacle orientation. This is problematic in the event that the peripheral, illustrated as a wireless communication antenna device 14 in FIG. 1, must be maintained in a particular physical orientation. For example, the antenna 14, to achieve optimal operating conditions, must preferably be in a vertically polarized position. If the antenna were interfaced with the host 10 via a fixed USB plug, then this may not be possible in the event that the host USB interface 12 is oriented in a different manner.

This problem is addressed by way of a connector adapter, one presently preferred embodiment of which is designated generally at 16 in FIG. 1. In general, the connector adapter 16 provides the physical and electrical interface between the USB receptacle 12 of the host, and the peripheral device, such as the wireless antenna 14. Moreover, as will be described in further detail below, the operative connection is provided in a manner such that, regardless of the physical orientation of the USB receptacle 12, the connector adapter 16 can be rotated so that the peripheral can be maintained in a single preferred physical position.

Figure 3:
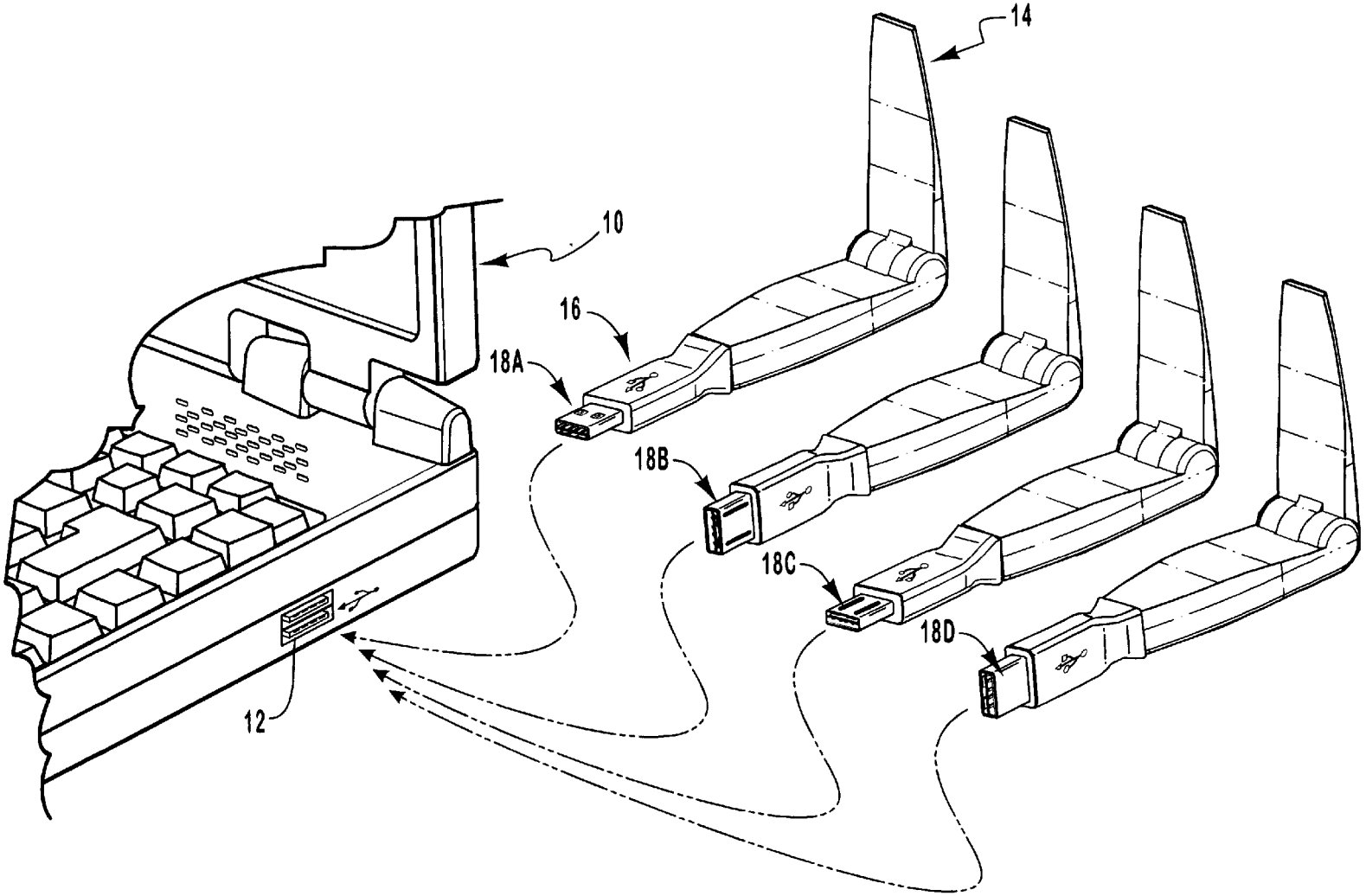
FIG. 3 illustrates a series of perspective views of a connector adapter presenting a USB plug in four different physical orientations so as to maintain a peripheral device in a single desired physical orientation with respect to a host device USB-type receptacle.

This ability to rotate, and thereby maintain the peripheral in a single preferred position, is best seen in FIG. 3. As is shown there, the connector adapter includes a USB plug portion 18 for interfacing with the corresponding USB receptacle 12 on the host. The rotational capability of the connector adapter 16 permits the plug 18 to be positioned in a plurality of different orientations, depending on the orientation of the host receptacle 12. In the illustrated embodiment, four discrete positions, 18A–18D are shown. Thus, regardless of the horizontal or vertical orientation of the receptacle 12, the physical orientation of the peripheral, such as antenna 14, need not vary.

Figure 2:
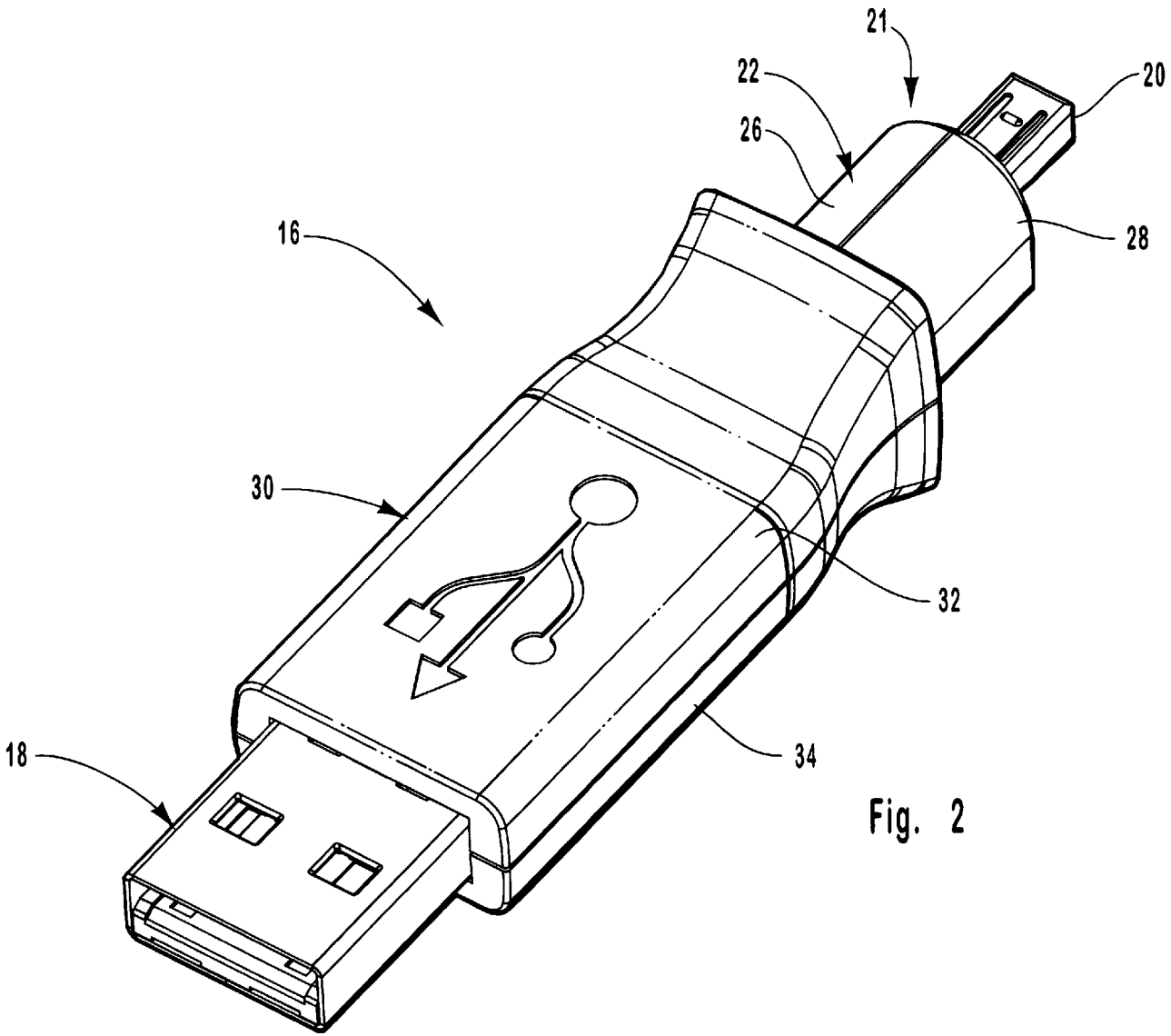
FIG. 2 is a perspective view of one presently preferred embodiment of a connector adapter constructed in accordance with the teachings of the present invention.
Figure 7:
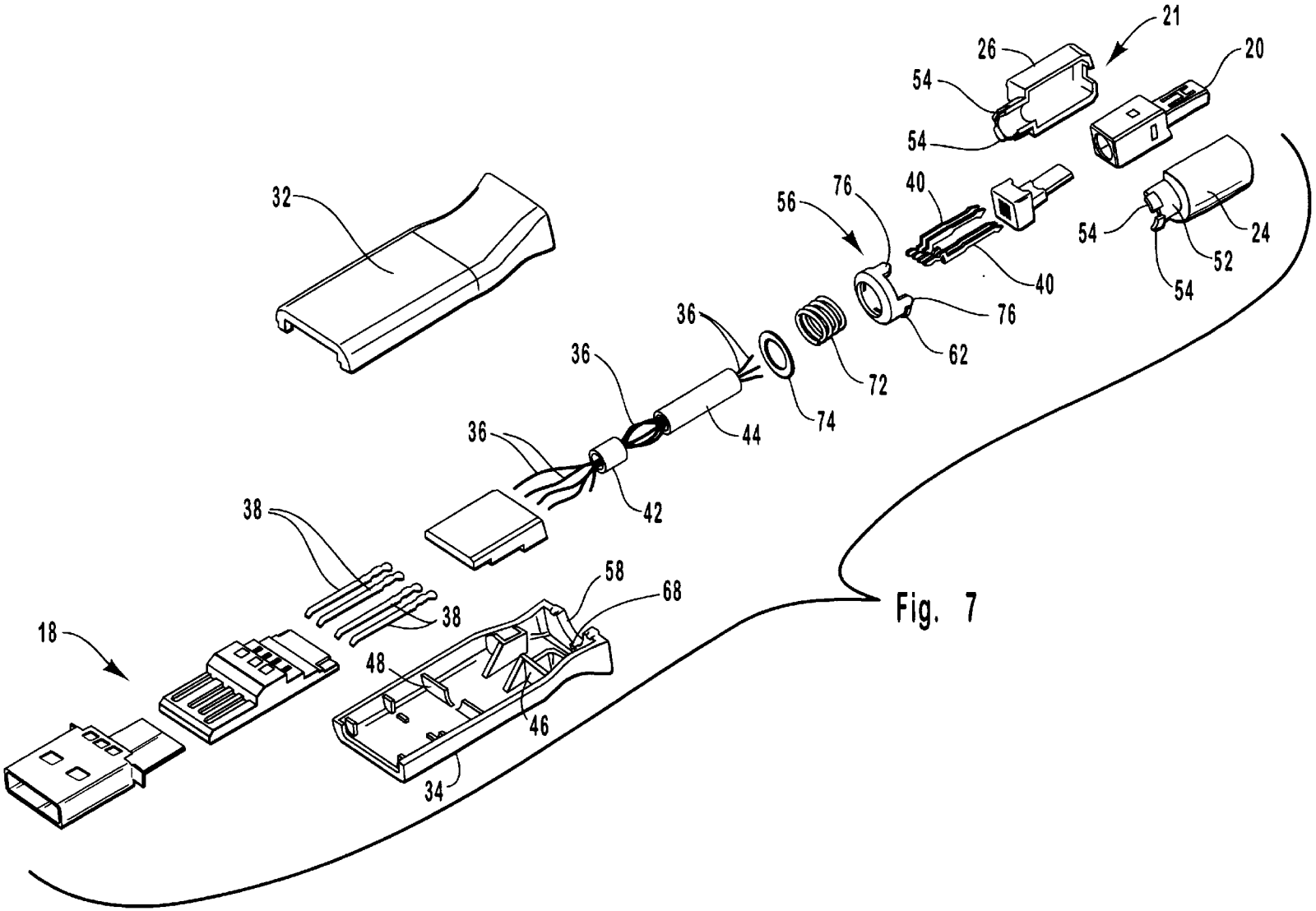
FIG. 7 is an exploded perspective view of one presently preferred embodiment of a connector adapter.

Referring now to FIG. 2, a presently preferred embodiment of the connector adapter 16 is shown. As is shown, the adapter 16 includes a host interface, which in the illustrated embodiment is a USB-compliant plug 18. The adapter also includes a peripheral interface, shown at 20, which is any suitable connector that is capable of providing an electrical and physical interface with the corresponding peripheral. In the illustrated embodiment, the peripheral interface 20 is comprised of a D-shaped outer cover 22 that is preferably comprised of two mated side portions 26, 28, as can also be seen in FIG. 7. The D-shaped outer cover 22 is sized and shaped so as to be operatively received within a corresponding recess 24 that is formed in the peripheral, such as is shown in antenna 14 in FIG. 1. In the illustrated embodiment, the peripheral interface further includes an electrical plug 20, that is adapted to interface with a complementary electrical connector (not shown) disposed within the recess 24 of the peripheral antenna 14 device. It will be appreciated that while the peripheral interface 21 is described and illustrated as having the configuration of FIG. 2, that any suitable electrical connector scheme could be used, depending on the connection interface requirements of the particular peripheral involved. For example, the interface 21 could be comprised of a standard connector scheme, and could even be another USB-type connector interface.

With continued reference to FIG. 2, in a presently preferred embodiment the connector adapter 16 is further comprised of an outer housing 30, constructed of plastic or any other suitable material. The housing 30 could be formed from single integral piece, or, as in the illustrated embodiment, from multiple pieces, such as top 32 and bottom 34 portions. In an alternative embodiment, the housing 30 may be constructed of a flexible material, such as rubber or a similarly resilient material, so as to provide a level of strain relief along the length of the adapter. In this type of embodiment, the connector adapter would be less subject to breakage when attached to the host system.

In a presently preferred embodiment, the host interface (i.e., USB plug 18) is held in a fixed relationship with respect to the housing 30. On the other hand, the peripheral interface 21 is interconnected with the housing 30 portion in a manner so as to permit selective movement and reorientation of the peripheral interface 21 with respect to the housing 30. In the preferred embodiment, the interconnection is provided so that the peripheral interface 21 can rotate with respect to the housing 30. This allows reorientation of the plug 18 to accommodate different USB receptacle orientations, and allows a fixed position of the peripheral interface 21 and corresponding peripheral device, such as antenna 14—as for example is shown in FIG. 3. It will be appreciated however that the rotational interconnection could be provided anywhere along the axis of the connector adapter 16 so as to achieve the same purpose. For example, the host interface portion 18 could have the rotational inter-connection with respect to the rest of the housing, and the peripheral interface a fixed connection. Alternatively, multiple rotation points could be implemented along the axis of the adapter 16. For example, both the peripheral interface 21 and the host interface 18 could be rotationally interconnected with the housing.

Figures 4, 4A:
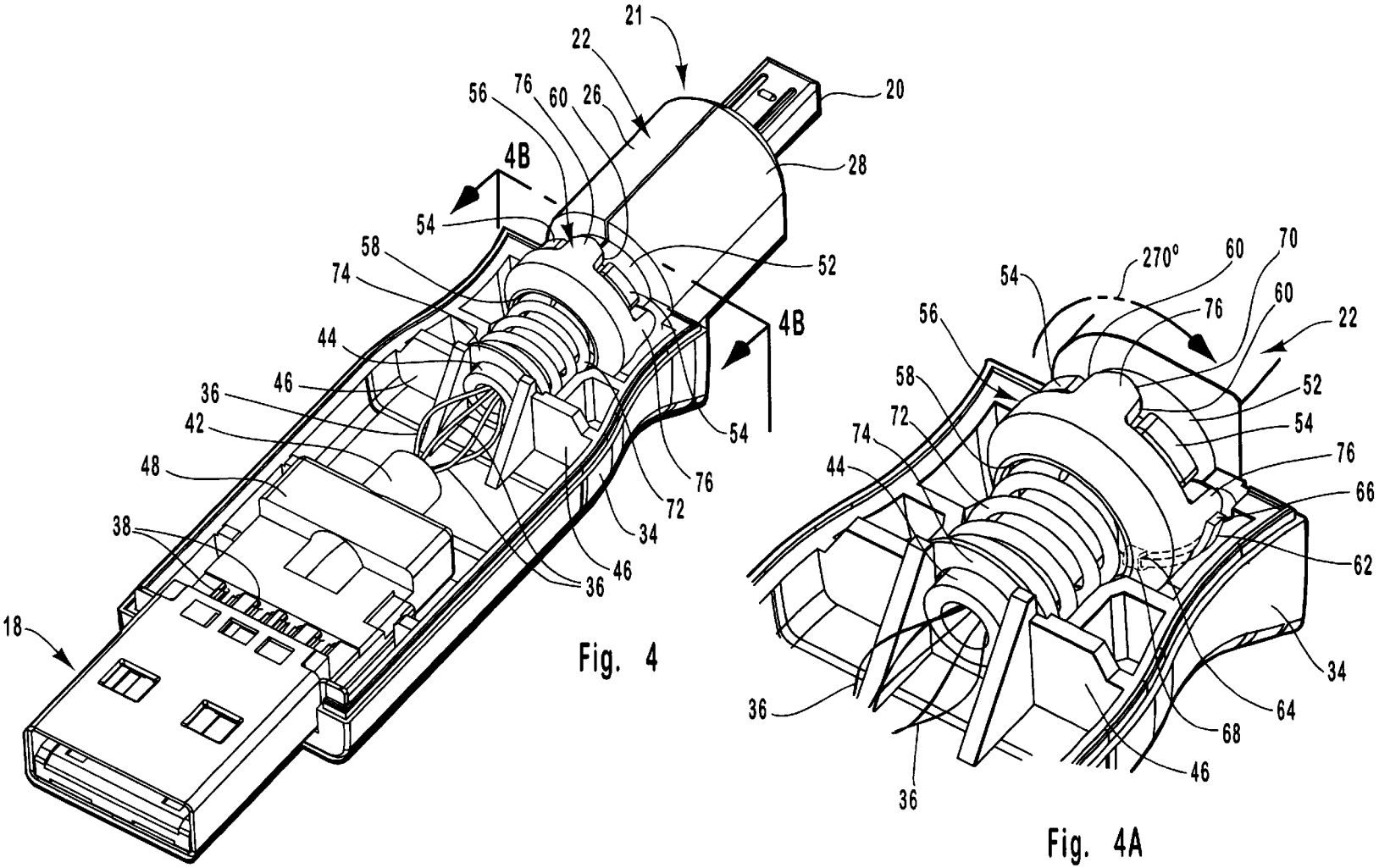
FIG. 4 is a perspective view of a partially assembled exemplary connector adapter.
FIG. 4A is a perspective view showing additional details of the connector adapter of FIG. 4.
Figure 5:
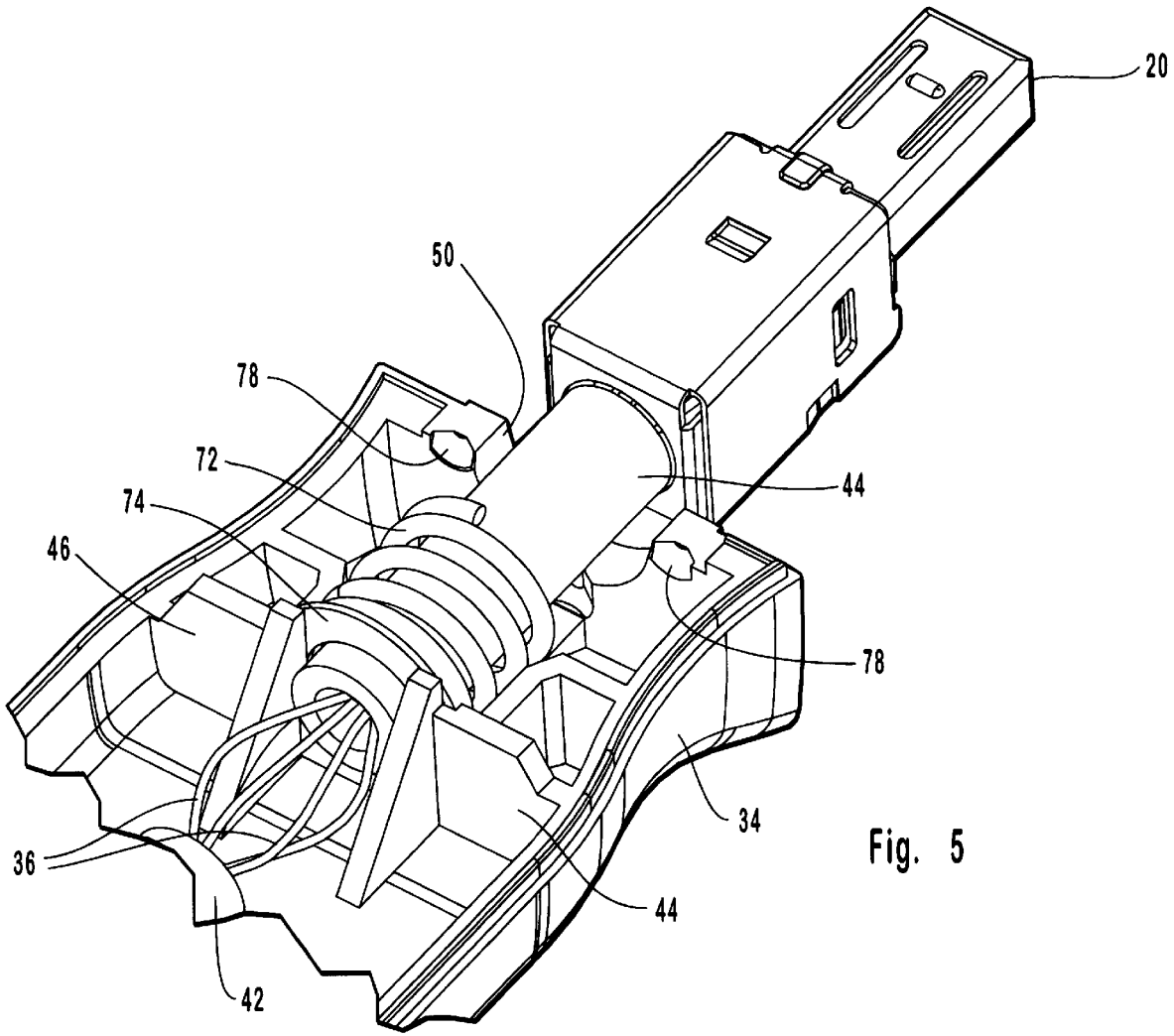
FIG. 5 is a perspective view of a portion of the connector adapter of FIG. 4.
Figure 6:
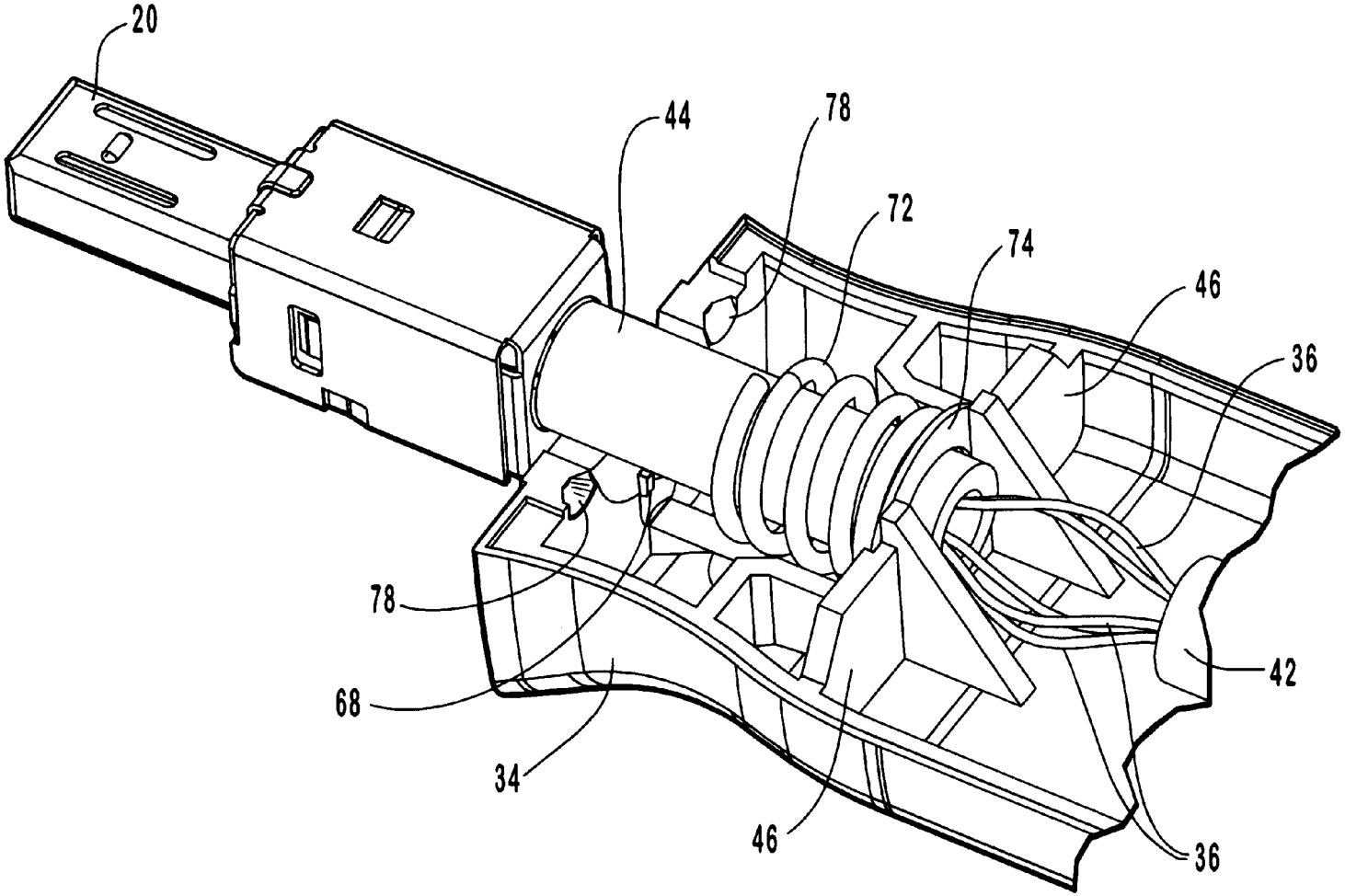
FIG. 6 is a perspective view of a portion of the connector adapter of FIG. 4.

Reference is next made to FIGS. 4 and 4A together, which illustrate additional details of a presently preferred embodiment of the connector adapter 30. As can be seen with the top cover 32 of the housing removed, the housing 30 forms an internal cavity, within which is disposed the appropriate electrical interconnection means between the host interface 18 and the peripheral interface 21. In the illustrated embodiment, the electrical interconnection is provided by way of an appropriate number of cables 36, that interconnect the electrical contacts 38 of the host interface 18 (USB plug), and the electrical contacts 40 (FIG. 7) of the peripheral interface 21. Again, the number of wires and interconnection scheme will be dictated by the types of connectors used, and the peripheral being used. Preferably, the wires 36 are at least partially disposed within a cylindrical wiring harness, shown as two portions 42 and 44. Further, the wiring harness 42, 44 is preferably held substantially fixed within the cavity by any appropriate means, such as support ribs 46, molded housing portion 48, or any other suitable retention scheme. The wiring harness 44 extends through an access hole 50 formed at one end of the housing 30, as can best be seen in FIG. 5, and is appropriately secured to the peripheral interface 21. It will be appreciated that in the event that the housing is constructed of a resilient/flexible material, as noted above, the support ribs 46 may have a different configuration so as to provide a sufficient level of support to the adapter, and yet allow a level of flexibility. Also, in this embodiment, the spring 72 (discussed below) may be provided with a longer length, so as to provide further structural support to the flexible adapter.

In a preferred embodiment, the access hole 50 of the housing 30 receives a stepped-down cylindrical end 52 of the D-shaped housing 22. Formed on the periphery of this cylindrical end 52 are a plurality of locking nubs 54. With the top and bottom covers 32, 34 assembled with the end 52 received within the access hole 50, the size of the locking nubs 54 prevent retraction of the D-shaped housing 22 from the access hole 50. This notion is also seen in the cross-sectional views of FIGS. 4B–4D. In this way, the peripheral interface 21 is allowed to freely rotate with respect to the rest of the connector adapter 16 housing 30.

It will be appreciated that in the preferred embodiment, unlimited rotation of the peripheral interface 21 could result in the twisting—and ultimate breakage—of one or more of the wires 36. As such, in one presently preferred embodiment, the connector adapter includes means for preventing over-rotation of the peripheral interface 21. In this way, the connector adapter can only be rotated to a predetermined rotational position in one direction, which in the preferred embodiment is 270° (as is shown in FIG. 3), thereby preventing any over-twisting and breakage of the internal wires 36.

By way of example and not limitation, the over-rotation prevention means is implemented with a dial index 56. As can be seen in FIGS. 4 and 4A, the dial index 56 has a bore 58 through which the wiring harness 44 and associated wires 36 are passed to the peripheral interface 21. The dial index 56 has formed therein locking recesses 60, which are sized and shaped so as to receive and engage the locking nubs 54 of the cylindrical end 52 of the cover 22. The locking engagement of the index 56 with the cylindrical end 52 is maintained by way of a biasing means, such as the spring 72 and washer 74 which bias the index 56 so as to engage with the end 52. Thus, rotation of the peripheral interface 21 results in a corresponding rotation of the dial index 56.

Also formed on the periphery of the dial index 56 is a ridge 62 having a first abutment edge 64 and a second abutment edge 66, which can be seen in FIGS. 4A–4D. The ridge 62 is sized and shaped so as to prevent over-rotation of the dial index 56 and peripheral interface 21. While any degree of rotation could be selected, in the preferred embodiment, the rotation is limited to the 270° mentioned above. The rotation is limited via placement of a stop surface 68, which in the preferred embodiment is placed on an interior surface of the housing 30 (FIGS. 4A–4D and FIG. 6).

Figure 4D:
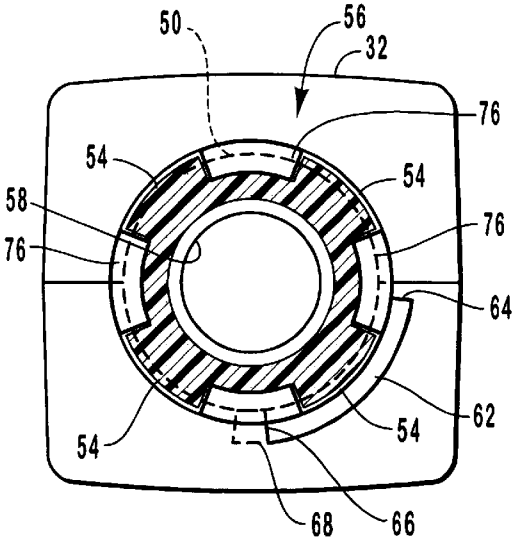
FIG. 4D is a cross-section view taken along lines 4B—4B in FIG. 4, illustrating yet another rotational position.
Figure 4C:
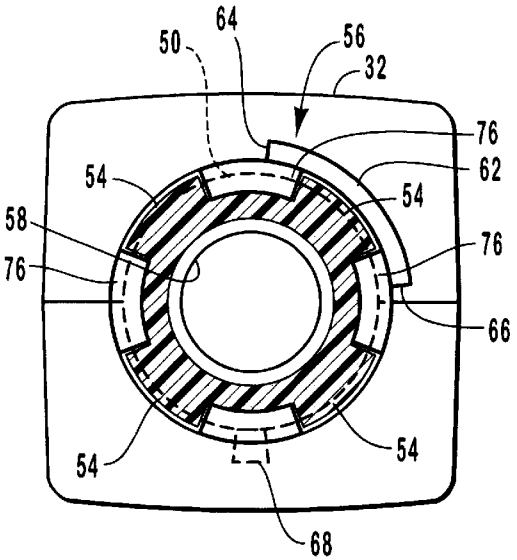
FIG. 4C is a cross-section view taken along lines 4B—4B in FIG. 4, illustrating another rotational position.
Figure 4B:
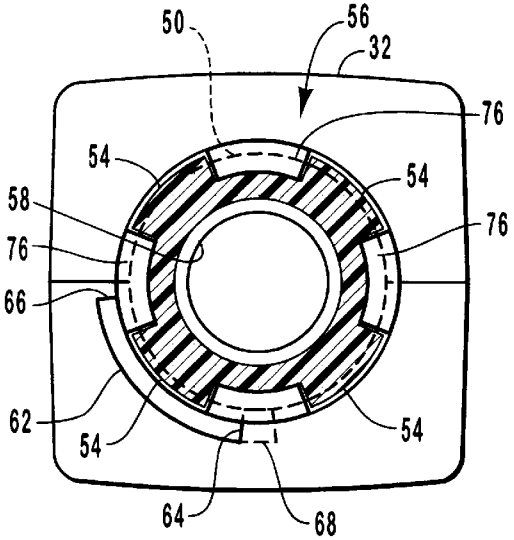
FIG. 4B is a cross-section view taken along lines 4B—4B in FIG. 4, illustrating one rotational position.

FIGS. 4A–4D illustrate one presently preferred example of how the dial index 56 provides the rotation limiting function. As is shown in FIGS. 4A and 4B, as the peripheral interface 21 and the index 56 are rotated in a clock-wise direction a full 270°, the first abutment edge 64 comes into contact with the stop surface 68 so as to prevent further rotation. The assembly can then only be rotated in the other direction, as is shown in FIG. 4C, until the second abutment edge 66 comes into contact with the stop surface 68, as is shown in FIG. 4D. It will be appreciated that the range of rotation can be altered by altering the size of the ridge 62.

In a presently preferred embodiment, the dial index 56 also provides an additional function. In particular, the index 56 provides the user with a tactile "click" feedback when the adapter has been rotated to and is "locked" at predetermined positions, which in the preferred embodiment are 90° increments (such as is shown in FIG. 3).

In the presently preferred embodiment, this function is provided by way of cam surfaces 70 formed on fingers 76 of the index 56, oriented at 90° increments about the index 56. Complementary recesses 78, shaped so as to receive the fingers 76, are formed within the inner surface of the housing 30. As the index 56 is rotated to each 90° position, the fingers 76 are received within a corresponding recess 78, and the index 56 is thus "locked" at that particular position. Moreover, when the position is reached, a clicking effect is provided as a result of the biasing force provided by the spring 72 (or similar biasing structure), thereby indicating to the user that the predetermined rotational position has been reached. Although a locking effect is provided, the index 56 can be rotated to a new position due to the cam surface shape 70 on the fingers 76. The amount of force required to disengage the locked position can be varied by altering the angle of the cam surfaces 70, and/or by varying the level of biasing force provided by the spring 72.

Further, while the illustrated embodiment provides locking positions at 90° increments, any increment can be provided with additional fingers and recesses.

It will be appreciated that while the above discussion has been directed to the description of one presently preferred embodiment of the invention, it should not be construed as limiting of the present invention. For example, a notebook computer has been illustrated as one type of host system, but any type of host computing environment could be utilized in connection with the present invention, including other computer system configurations, personal computers, hand-held devices, multi-processor systems, microprocessor-based or programmable consumer electronics, network PCs, minicomputers, mainframe computers, Personal Digital Assistants, digital cameras, and the like.

Moreover, while the present invention has been described in the context of the USB connection system, it would have applicability with any connection scheme that has a specific physical orientation that may not be appropriate for a particular peripheral device. For example, parallel ports, serial ports, RJ-type modular connectors, Firewire connectors and proprietary connection schemes would all find applicability with the present invention.

Also, the present invention is not limited to use with any type of peripheral device. For example, embodiments have been described with respect to an antenna, such as a short range wireless antenna operating under the industry standard know as "Bluetooth." Other antenna peripherals could also be used, as could other types of peripheral devices that may need to be directly connected to the host device and that may require physical reorientation with respect to the host connector interface.

To summarize, embodiments of the present invention are directed to a connector adapter that allows a peripheral to be operatively and directly connected to a host interface, thereby eliminating the need for cables and the like. Moreover, the connector adapter is adjustable, so that the peripheral can be oriented in any one of a plurality of physical positions. Thus, a peripheral, such as an antenna, can be positioned in an optimal orientation, regardless of the physical orientation of the host connection interface.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. A connector adapter comprising:

a first connector, capable of interfacing with a host connector disposed on a host computing device;

a second connector, capable of interfacing with a peripheral connector disposed on a peripheral device, the second connector being electrically connected to the first connector;

a rotating mechanism interconnecting the first connector and the second connector in a manner so as to permit rotation of the second connector with respect to the first connector, the rotating, mechanism including:

a rotation limiting mechanism that limits the degree of rotation of the second connector and the first connector between a first stop point and a second stop point;

a plurality of lock points that correspond to a plurality of predetermined rotational positions of the second connector, the plurality of lock points being disposed between the first stop point and the second stop point.

2. A connector adapter as defined in claim 1, wherein the first connector is a USB-type connector.

3. A connector adapter as defined in claim 1, wherein the peripheral device is an antenna.

4. A connector adapter comprising:

a first connector having a housing, the first connector being capable of electrically and physically interfacing with a host connector on a host computer;

a second connector having a housing, the second connector being capable of electrically and physically interfacing with a peripheral connector on a peripheral device;

an adapter housing, operably interconnecting the first and the second connector and defining an interior portion, and wherein the first connector is electrically connected to the second connector; and a rotating dial rotatably supported within the interior portion and configured to rotatably support an end of the housing of the second connector housing in a manner so as to permit rotation of the second connector with respect to the first connector.

5. A connector adapter as defined in claim 4 wherein the rotating dial includes a plurality of rotational position surfaces that each correspond to a predefined and locked rotational position of the dial and the second connector.

6. A connector adapter as defined in claim 4 wherein the rotating dial includes a rotation limiting mechanism that limits the degree of rotation of the dial and the second connector between a first stop point and a second stop point.

7. A connector adapter as defined in claim 5 wherein rotation of the rotating dial to one of said rotational positions causes an audible indication.

8. A connector adapter comprising:

a first connector capable of electrically and physically interfacing with a host connector on a host computing device;

a second connector capable of electrically and physically interfacing with a peripheral connector on a peripheral device;

at least one flexible electrical wire that electrically connects the first connector to the second connector; and a rotating structure that accommodates the at least one flexible electrical wire, and that rotational interconnects the first connector with the second connector in a manner so as to permit rotation of the second connector with respect to the first connector and further including a rotation limiting mechanism that limits the degree of rotation of the second connector and the first connector between predefined stop points.

9. A connector adapter as defined in claim 8, wherein the rotating, structure includes a rotatable dial that is operably connected to the first and the second connectors so as to permit rotation between the two, the rotatable dial including a bore formed therein that that permits passage of the at least one electrical wire.

* * * * *